United States Patent [19]

Nagengast et al.

[11] Patent Number: 4,833,572

[45] Date of Patent: May 23, 1989

[54] HEADLAMP VENTILATION SYSTEM

[75] Inventors: William E. Nagengast; John M. Luallin, both of Anderson, Ind.

[73] Assignee: General Motors Corporation, Detroit, Mich.

[21] Appl. No.: 237,803

[22] Filed: Aug. 29, 1988

[51] Int. Cl.[4] ..... F21V 29/00

[52] U.S. Cl. ..... 362/61; 362/294; 362/345

[58] Field of Search ..... 362/61, 80, 96, 294, 362/373, 345, 267

[56] References Cited

U.S. PATENT DOCUMENTS

| | | | |
|---|---|---|---|
| 4,249,232 | 2/1981 | Dick | 362/61 |
| 4,569,007 | 2/1986 | Dick | 362/294 |
| 4,635,173 | 1/1987 | Dressler et al. | 362/294 |
| 4,658,339 | 4/1987 | Tammerijn et al. | 362/373 |
| 4,747,032 | 5/1988 | Weber | 362/294 |

FOREIGN PATENT DOCUMENTS

| | | | |
|---|---|---|---|
| 3220704 | 3/1984 | Fed. Rep. of Germany . | |
| 575976 | 3/1946 | United Kingdom | 362/294 |
| 2089957 | 6/1982 | United Kingdom | 362/61 |

*Primary Examiner*—Ira S. Lazarus
*Assistant Examiner*—D. M. Cox
*Attorney, Agent, or Firm*—Edward J. Biskup

[57] ABSTRACT

A ventilation system for a replaceable bulb headlamp in which the reflector member is formed with at least two slots in line with and behind the sealant channel and each slot is adapted to slidingly receive a vent device which establishes a labyrinth-type flow path for air to enter and exit from the interior of the headlamp.

3 Claims, 3 Drawing Sheets

HEADLAMP VENTILATION SYSTEM

This invention concerns headlamps of the relaceable bulb type and more particularly relates to a ventilation system for such headlamps.

Copending application Ser. No. 182,559 in the name of Paul D. Van Duyn filed on Apr. 18, 1988 discloses a ventilation system for headlamps in which the sealant channel for the lens along the opposite side edges and along the bottom edge of the reflector member is formed with separate elongated recesses, each of which is covered with an L-shaped plate so as to form a passage which serves to communicate the interior of the headlamp with the atmosphere.

The present invention is similar to the above described ventilation system in that the passage for ventilation purposes in this invention is provided immediately behind and in line with the aforesaid sealant channel for the lens. However, rather than utilizing a plate to cover the passage, we provide a vent device in the form of an insert which has a passage bored therethrough that is adapted to be connected directly with a port located within the cavity for delivering air to or from atmosphere into or out of the interior of the headlamp. In the preferred form, the ventilation system according to the present invention utilizes a plastic insert which is generally rectangular in configuration and is provided with a pair of parallel and interconnecting passages each of which is connected to an opening. The arrangement is such that when the insert is placed within a cavity, one opening in the insert is directly connected to the port of the cavity while the other opening connects with the interior of the headlamp. Thus, the passages formed in the insert establish a path which permits both the draining and venting of the headlamp. In addition, the insert can be positioned in a variety of locations around the perimeter of the headlamp so long as there are at least two inserts provided so as to create an airflow. One insert is always located along the lower channel of the reflector member at a low point so as to serve as a combined drain and an airflow device.

The objects of the present invention are to provide a new and improved ventilation system for a replaceable bulb headlamp in which a pair of spaced slots are formed in line with and behind the usual sealant channel and each slot is adapted to slidingly receive a vent device which establishes a labyrinth-type flow path for air to enter into and exit from the interior of the headlamp; to provide a new and improved ventilation system for a rectangular replaceable bulb headlamp in which an insert is slidably received within a slot formed in the perimeter of a reflector member for establishing an airflow path between the interior of the headlamp and atmosphere for ventilating the headlamp; and to provide a new and improved ventilation system for a replaceable bulb headlamp having a plug-type member containing an internal baffling system to prevent water and dust from entering the interior of a lamp housing and being adapted to be positioned in pairs around the perimeter of the lamp housing to create airflow and thereby vent the interior of the headlamp.

Other objects and advantages of the present invention will be apparent from the following detailed description when taken with the drawings in which FIG. 1 is a front perspective view of a replaceable bulb headlamp with the lens broken away so as to more clearly show the ventilation system made according to the present invention;

Figure 1:
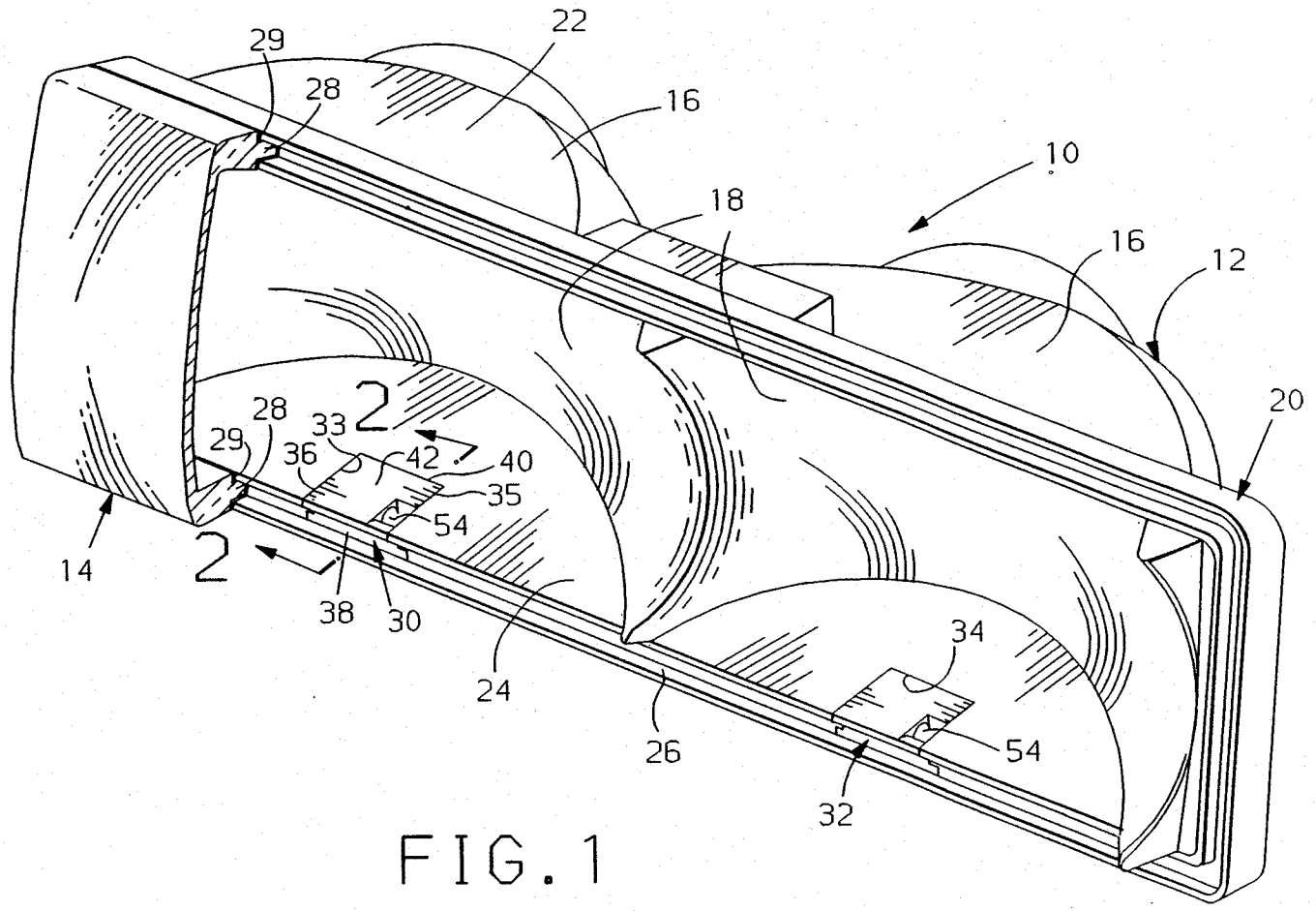

Referring now to the drawings and more particularly FIG. 1 thereof, a replaceable headlamp 10 is shown of the rectangular-type comprising a reflector member 12 made of a plastic material and having the front face thereof adapted to be closed by a glass or plastic lens 14. In this instance, the reflector member 12 includes a pair of side-by-side cavities each of which is formed by a pararbolic portion 16 the interior portion of which is aluminized so as to provide a parabolic concave reflecting surface 18 for projecting a forwardly directed beam of light provided by a replaceable bulb (not shown) positioned within a socket located in the center of the associated cavity.

More specifically, the front face of the reflector member 12 is defined by a rectangular flange 20 integrally formed with an surrounding the open end of the two parabolic portions 16. A horizontally orientated top wall 22 and a horizontally orientated bottom wall 24 integrally formed with each of the parabolic portions are also integral with the flange 20. A continuous channel 26 of uniform depth is formed in the flange 20 of the reflector member 12 around the entire margin of the front face thereof. As is conventional, the lens 14 has an axially extending projection 28 adapted to be located within the channel 26 and is to be bonded to the front face of the reflector member 12 by an adhesive such as butyl rubber 29 which can also serve as a sealant.

In order to vent the headlamp 10 so as to prevent moisture from collecting in the interior thereof, a ventilation system is provided which as seen in FIG. 1 includes a pair of vent devices 30 and 32 which are intended to be mounted in a pair of identical slots 33 and 34 formed in the bottom wall 24 of the reflector member 12. Each of the vent devices 30 and 32 is identical in construction and, consequently, the vent device 30 seen in FIGS. 2–5 shall be described in detail and the corresponding parts thereof found in the vent device 32 shall be identified by the same reference numerals.

In this regard and as best seen in FIGS. 2–5, the vent device 30 is a plastic part shown located within the slot 33 of the bottom wall 24 of the reflector member 12. The vent device 30 is generally rectangular in configuration and includes a pair of side walls 35 and 36, a front wall 38, back wall 40, top wall 42, and a bottom wall 44. A pair of parallel passages 46 and 48 are formed in the body portion of the vent device and are connected at one end to each other adjacent an oblong opening 50 formed in the side wall 36. The passages 46 and 48 are connected at their opposite ends to ports 52 and 54 fromed in the back wall 40 and the top wall 42, respectively. The side walls 35 and 36 of the vent device 30 are formed integrally with identical guide rails 56 and 58, respectively, while the front wall 38 has an integral lip 60 which extends outwardly therefrom.

The slot 33 is of a configuration complementary to the vent device 30 and is defined by a back wall 62, laterally spaced side walls 64 and 66, and a bottom wall 68. The side walls 64 and 66 are formed with parallel guide channels 70 and 72 which begin at the sealant channel 26 and terminate at the back wall 62. In addition, the back wall 62 of the slot 33 is provided with a through-passage or port 74 which is adapted to connect the slot 33 with atmosphere as will hereinafter be explained.

Figure 2:
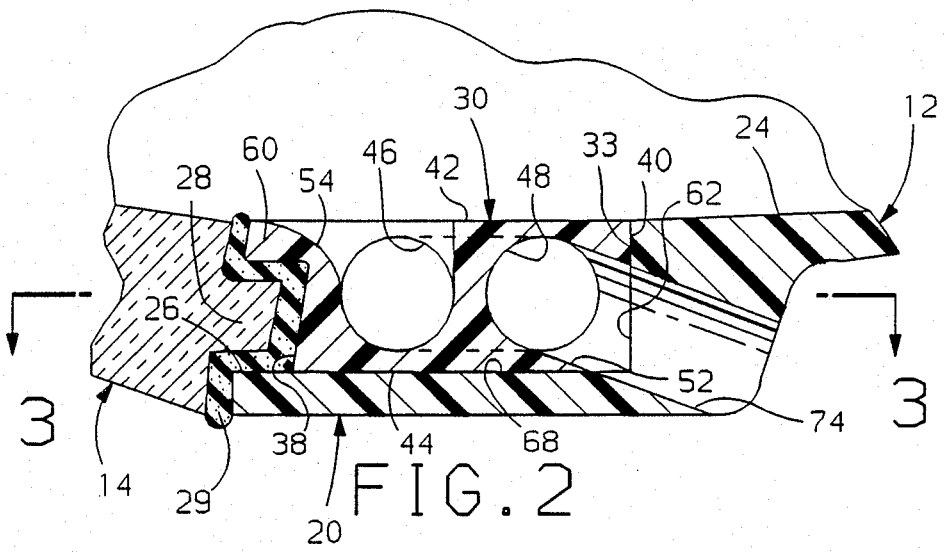
FIG. 2 is an enlarged sectional view taken on line 2—2 of FIG. 1 showing one of the vent devices for providing airflow between the interior of the headlamp and atmosphere.
Figure 3:
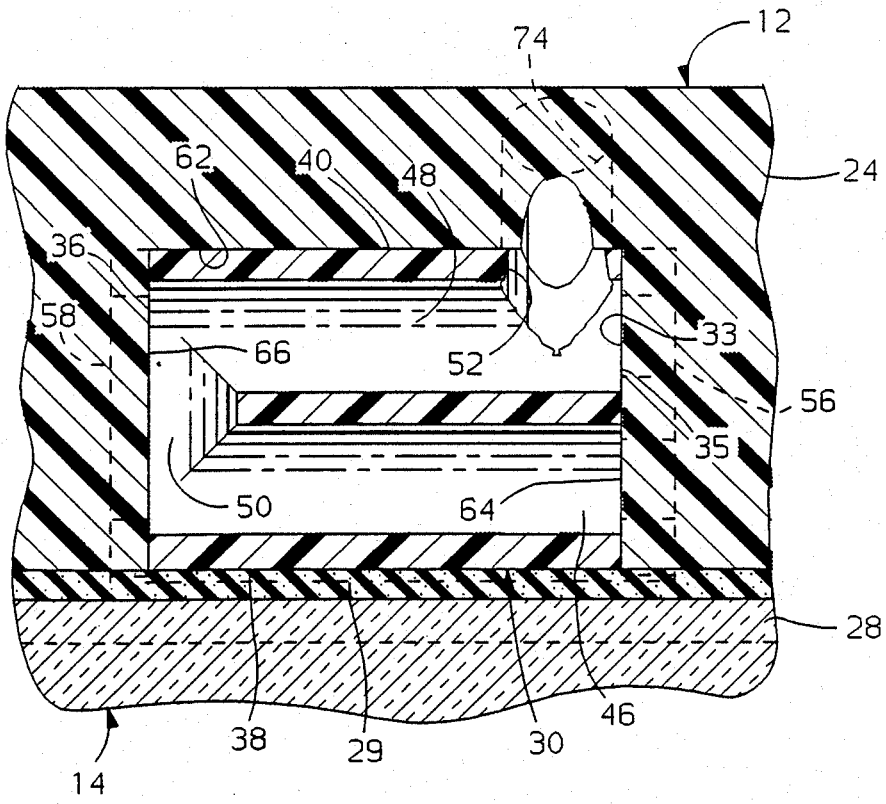
FIG. 3 is a sectional view taken on line 3—3 of FIG. 2.
Figure 4:
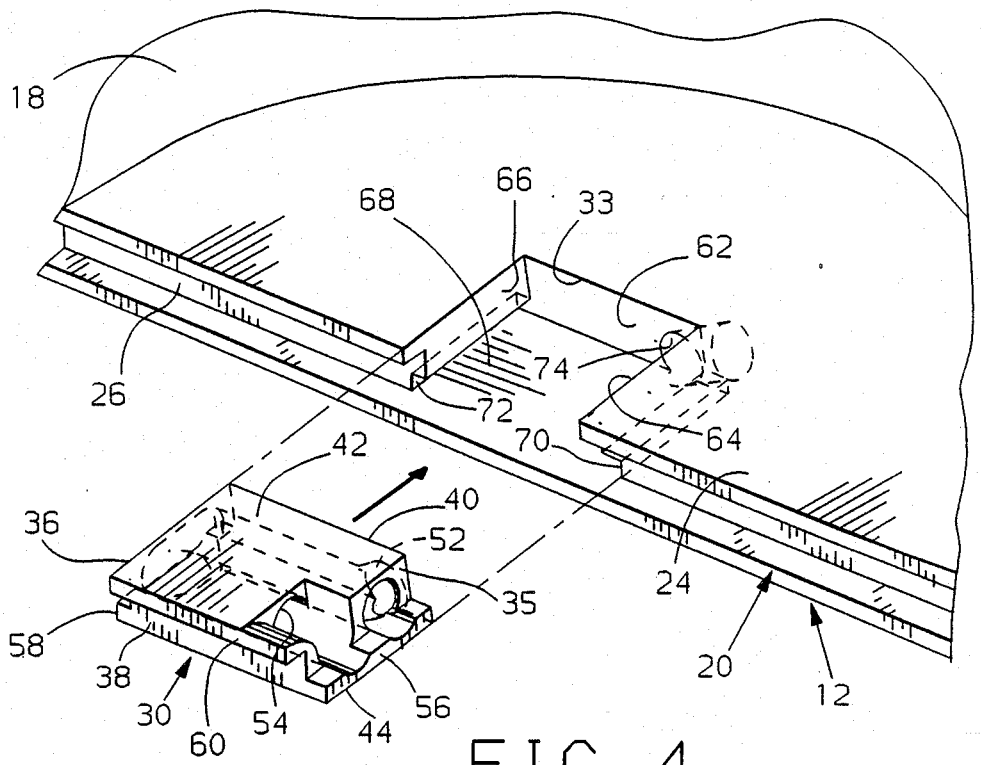
FIG. 4 is a perspective view of one of the plug-type inserts removed from its accommodating cavity formed in the perimeter of the reflector member in line with the sealant channel.
Figure 5:
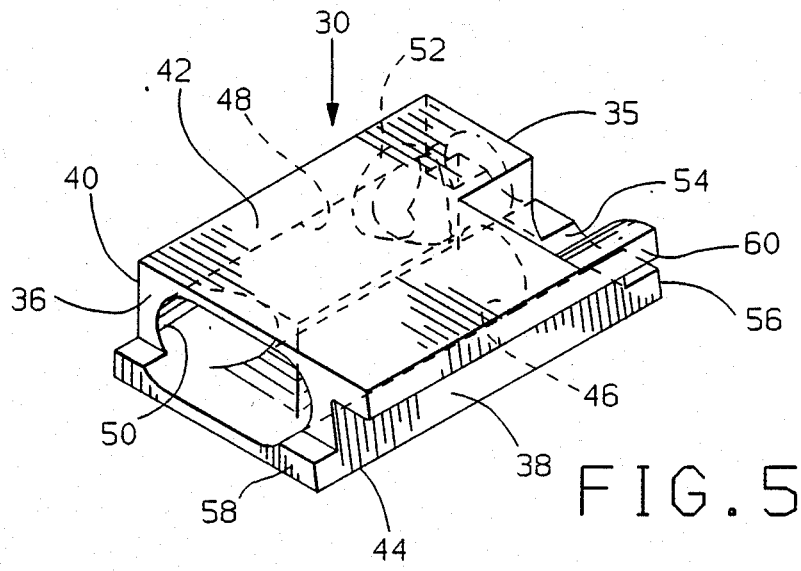
FIG. 5 is an enlarged perspective view of the plug-type insert seen in FIG. 4—4.

As best seen in FIG. 4, the vent device 30 is insertable into the slot 33 by initially locating the guide rails 56 and 58 in line with the guide channels 70 and 72 and moving the vent device 30 inwardly until the back wall 40 of the vent device 30 contacts the back wall 62 of the slot 33. Once the vent device 30 is fully located within the slot 33, it assumes the position shown in FIGS. 1–3 wherein the top wall 42 is generally located in the plane of the wall 24 of the reflector member 12. In addition, the port 52 formed in the vent device 30 is connected with the passage 74 formed in the back wall 62 of the reflector member 12, the oblong opening 50 in the side wall 36 is closed by the side wall 66 of the slot 33, and the port 54 in the top wall 42 of the vent device 30 opens into the interior of the headlamp 10. At the same time, the lip 60 cooperates with the front wall 38 of the vent device 30 and bottom wall 68 of the slot to provide a channel which as seen in FIGS. 1 and 3 is in alignment with the sealant channel 26 formed in the reflector member 12.

Thus, as seen in FIG. 1 when the vent devices 30 and 32 are installed into the accommodating slots 33 and 34, air can flow between the two vent devices 30 and 32 through the interior of the headlamp 10 for ventilation purposes. Also, installation of each of the vent devices 30 and 32 is a simple matter requiring no more than pushing the body portion of each vent device 30 and 32 into its accommodating slot as heretofore described. The pair of passages 46 and 48 serve to provide a baffling system designed to prevent the inward flow of water during car washes or when the car travels through puddles or a rainstorm. The passages 46 or 48 also provide a labyrinth path which serves to inhibit airborne dust from entering the interior of the headlamp 10. Finally, and as seen in FIGS. 2 and 3, each vent device 30 and 32, when installed into its accommodating slot, will allow air to flow via port 54, passage 46 and passage 48 to the port 52 and through the passage 74 to atmosphere. Obviously, a reversal of airflow is possible with each vent device 30 and 32. With the vent devices 30 and 32 spaced as seen in FIG. 1, air can flow into the interior of the headlamp 10 through vent device 30 and exit through vent device 32. As alluded to hereinbefore, the vent devices 30 and 32 can be positioned in a variety of positions around the perimeter of a headlamp so long as there are two vent devices to create an airflow.

Various changes and modifications can be made to the above described ventilating system without departing from the spirit of the invention. Such changes and modifications are contemplated by the inventors and they do not wish to be limited except by the scope of the appended claims.

The embodiments of the invention in which an exclusive property or privilege is claimed are defined as follows:

1. A ventilation system for a replaceable bulb headlamp in which the headlamp comprises a rectangular reflector member the front face of which is closed by a rectangular lens, said lens member having an outer flange provided with a projection location within a channel formed around the entire margin of said front face of said reflector member, said channel having an adhesive for bonding said lens member to said reflector member, the improvement comprising a slot formed in the reflector member in line with said channel and being connected to a port leading to atmosphere, a vent device conforming in configuration to said slot and having a labyrinth type passage formed therein, said vent device adapted to slide into said slot and be connected to said port and provide airflow into said headlamp when said vent device is fully positioned within said slot.

2. A ventilation system for a replaceable bulb headlamp in which the headlamp comprises a rectangular reflector member the front face of which is closed by a rectangular lens, said lens member having an outer flange provided with a projection located within a channel formed around the entire margin of said front face of said reflector member, said channel having an adhesive for bonding said lens member to said reflector member, the improvement comprising a rectangular slot formed in the reflector member in line with said channel and being connected to a port leading to atmosphere, a pair of guide channels formed in the side walls of said slot, a vent device conforming in configuration to said slot and having a pair of parallel passages formed therein, said vent device having a pair of guide rails adapted to cooperate with said guide channels for allowing said vent device to slide into said slot and be connected to said port and provide airflow into said headlamp when said vent device is fully positioned within said slot.

3. A ventilation system for a replaceable bulb headlamp in which the headlamp comprises a rectangular reflector member the front face of which is closed by a rectangular lens, said lens member having an outer flange provided with a projection located within a channel formed around the entire margin of said front face of said reflector member, said channel having an adhesive for bonding said lens member to said reflector member, the improvement comprising a rectangular slot formed in the reflector member in line with said channel and being connected to a port leading to atmosphere, a pair of guide channels formed in the side walls of said slot, a vent device conforming in configuration to said slot and having passage means formed therein, said vent device having a pair of guide rails adapted to cooperate with said guide channels for allowing said vent device to slide into said slot and be connected to said port and provide airflow into said headlamp when said vent device is fully positioned within said slot, and means formed with the frontal portion of said vent device for providing a continuation of said channel and for receiving said adhesive for bonding said lens member to said reflector member.

* * * * *